United States Patent [19]

Vause

[11] 4,012,658

[45] Mar. 15, 1977

[54] ELECTRIC LAMPS MOUNTED IN A FLANGED CAP

[75] Inventor: Arthur Samuel Vause, London, England

[73] Assignee: Thorn Electrical Industries Limited, London, England

[22] Filed: Nov. 26, 1975

[21] Appl. No.: 635,363

[30] Foreign Application Priority Data

Nov. 28, 1974 United Kingdom ..... 51636/74

[52] U.S. Cl. ..... 313/318; 313/315; 339/144 R; 339/145 R

[51] Int. Cl.[2] ..... H01J 5/48; H01J 5/50

[58] Field of Search ..... 313/315, 317, 318; 339/145 R, 145 D, 146, 144

[56] References Cited

UNITED STATES PATENTS

| | | | |
|---|---|---|---|
| 2,132,578 | 10/1938 | Reichel | 313/318 X |
| 3,848,120 | 11/1974 | Wolfe et al. | 313/318 |
| 3,885,149 | 5/1975 | Wolfe et al. | 313/318 |

*Primary Examiner*—Saxfield Chatmon, Jr.
*Attorney, Agent, or Firm*—Robert F. O'Connell

[57] ABSTRACT

An electric lamp assembly for use in sealed beam lighting units comprises a sealed envelope containing a light source mounted in an integnally flanged cap. Electrical supply leads pass through hermetic seals in the cap, and means are provided which support the light source in a predetermined position relative to the cap flange.

3 Claims, 1 Drawing Figure

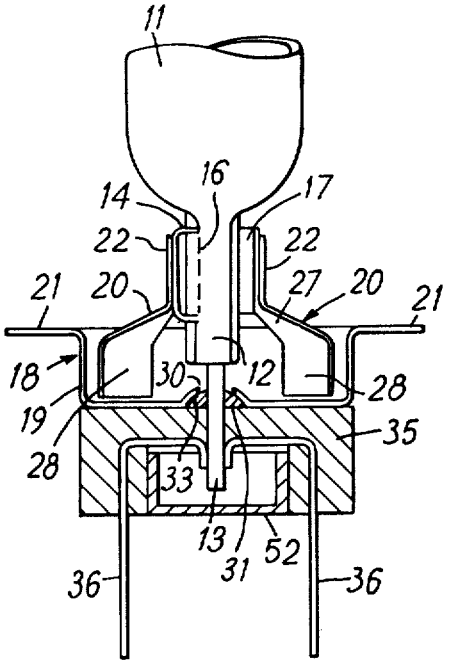
11
16
14
17
22
22
21
20
27
20
21
18
30
12
28
19
35
28
33
13
31
52
36
36

ELECTRIC LAMPS MOUNTED IN A FLANGED CAP

FIELD OF THE INVENTION

The present invention relates to electric lamps of the type used in sealed beam lighting units and in precision demountable systems such as projectors for slides and cine films. An obstacle to the manufacture of sealed beam lighting units, particularly those units which are other than of all-glass construction, has been the non-availability of a suitable hermetically sealed light source assembly.

DESCRIPTION OF THE PRIOR ART

Normal types of lamp cap are not suitable for satisfactory sealing into sealed beam units. The ends of such caps remote from the lamp bulb, through which electric contacts are normally fitted, are customarily filled with insulating glass (Vitrite) or plastics material, which holds the contact members in place. Such materials do not wet the materials from which the contact members and caps are usually made, and so rather poor bonding results and the contact members are not held in place with sufficient strength to withstand forces applied externally when a connector is fitted. Furthermore, the fill material, contact members and cap do not have matching thermal expansion characteristics. Thus, secure, hermetic sealing between these parts is not maintained over the full range of temperature variation experienced by lamps between extremes of service conditions.

This problem of securing contact members mechanically and hermetically, experienced over the years with the established forms of incandescent filament lamp, becomes even more severe with more modern light sources such as incandescent tungsten halogen or high-intensity discharge types of lamp. These operate at a much higher power per unit volume than ordinary filament lamps, and hence undergo a wider range of variations between ambient and maximum operating temperatures. Thus mechanically strong, hermetic sealing of lighting units comprising such lamps is more difficult.

SUMMARY OF THE INVENTION

According to the present invention there is provided an electric lamp comprising an envelope containing a light source having supply leads, a seal in the envelope through which the leads pass, and a lamp cap having air-tight seals through which the supply leads pass wherein a support maintains the light source at a fixed position relative to the flange, and wherein the flange is integral with the cap and peripheral thereto. The construction is such that, if the envelope is passed through an aperture in a reflector element of a sealed beam lighting unit and the flange is hermetically sealed to the reflector element, air cannot enter the unit.

A knowledge of the fixed position of the light source relative to the flange, or of the predetermined distance therebetween, enables a designer to develop lighting units whether sealed or demountable, so to accept the lamp that, when the flange abuts a mounting surface of the lighting unit, the light source is focussed with respect to optical components of the unit.

Preferably, the flange is symmetrical about a longitudinal axis passing through the centre of the lamp, and the flange is substantially planar. In some cases, however, the flange may be otherwise, for example to mate with a curved reflector.

In the preferred construction, the cap comprises a flanged cup, which contains the end of the envelope seal. Supply leads are sealed through the cap, and a support or lid is secured to the lamp seal and to the cap. The predetermined distance may be set during assembly of the lamp, and may then be fixed by soldering.

The leads are each sealed in apertured depressions in the cup and electrically insulated therefrom by means of vitreous or plastics sealing materials of thermal expansion matching those of the leads and cap. The leads are connected to terminals which are attached to an insulating member fixed to the cap.

BRIEF DESCRIPTION OF THE DRAWINGS

An embodiment of the invention will now be described, by way of example, with reference to the accompanying drawing which shows, partially in section, a portion of a lamp construction embodying the invention.

DETAILED DESCRIPTION

The illustrated lamp construction is intended primarily for use in the manufacture of sealed beam lighting units. Nevertheless, it is also suitable for demountable lighting systems such as slide and cine projectors. The construction embodies means for locating the light source accurately within the associated lighting unit. Although the embodiment is illustrated and described with reference to incandescent light sources, it should be understood that discharge light sources could be used instead. Such sources would possess within their envelope, a pair of discharge electrodes and a gaseous or metal vapour filling.

In the Figure, a lamp has a vitreous envelope 11 containing one or more filaments, the envelope terminating in a pinch seal 12. Leads 13 pass through the pinch seal 12 for connection to an external supply of electricity. The pinch seal 12 is formed by jaws which shape a depression in one face of the seal 12 suitable for locating a substantially conventional capping box 14 accurately with respect to the filament light source within the envelope 11. The capping box 14 is formed from bent sheet metal and has inturned flanges 16 which seat in the pinch seal depression and prevent movement of the envelope relative to the capping box 14. An inturned tongue 17 of the capping box 14 urges the flange 16 into firm seating engagement with the depression.

A metallic lamp cap 18 is fixed to the capping box 14 by means of a support or lid 20, the cap 18 forming an enclosure containing the end of the seal 12. The cap 18 comprises a cup 19 and an integral flange 21 which, in use, serves as means for locating the lamp in the associated lighting unit. A tubular portion 22 of the support 20 is soldered to the capping box 14 and peripheral portions of the support 20 form arcuate legs 28 which fit inside the cup 19. The support 20 has a portion 27 of tapered, conical form between its tubular portion 22 and its legs 28, and it is fixed to the cap 18 by soldering braging and welding its legs 28 in a position to set the flange at the predetermined distance from the light source.

The base of the cap 18 has a plurality of coined depressions 33 having openings 30 therein. The number of openings 30 and depressions 33 is equal to the number of leads 13.

When assembling the lamp, it is convenient to fit the envelope 11 to the lamp cap 18 in two stages. The first stage comprises fitting the capping box 14 to the seal 12, and fitting the support 20 to the capping box. The second stage comprises the insertion of the leads 13 through openings in the cap 18 and the securing of the cap to the support 20.

The leads 13, of which only one is shown, which emerge from the end of the seal 12, are arranged to pass through corresponding openings 30 as the support 20 is inserted into the cap.

A jig is used to locate the support 20 in the cup 19 so that the flange 21 is at the predetermined distance from the light source and the two parts 19 and 20 are soldered together in this position. The assembly is then inverted from its position as shown in the Figure, and beads of vitreous or plastics electrically insulating sealing material with a coefficient of thermal expansion matching those of the leads 13 and the cap 18 are slipped over the ends of the leads 13 so as to seat in the coined depressions 33 surrounding the openings 30 in the cap 18. The assembly is then passed through a heated oven to fuse the beads and to form seals 31 with the lead wires 13 through the openings 30. The oven contains an inert atmosphere so as to avoid oxidation of exposed metal surfaces.

An insulating member 35, with terminals 36 attached, is bonded to the base of the cap 18. Each terminal 36 has an aperture and is crimped to its associated lead wire 13. The member 35 has a large recess providing access for a crimping tool. A closure member 52 is fitted into this recess upon completion of the lamp.

A completed lamp of the type described is ready for incorporating in a sealed beam lighting unit. Such a unit may comprise a front lens element bonded to a rear, apertured reflector element, to which a lamp is fitted. The lamp is secured in place, with its envelope 11 passed through the aperture and its flange 21 abutting the back of the reflector, either by bonding with an adhesive such as an epoxy resin, or by soldering if the reflector is metal. The use of a lamp of the type described provides a light source at a known position with respect to the optical geometry of the lens and reflector elements and ensures that the sealed beam lighting unit is gas-tight. The use of lamps of standard dimensions and having a flange set at a predetermined distance from their light source simplifies manufacture of sealed beam units. The lamps can be made at one site in a factory equipped with appropriate lamp making machinery and can be transported to another site for assembly into sealed beam units in another factory. This relieves a manufacturer of sealed beam units of the need to make lamps himself.

The lamp can, of course, be used in a demountable system, as distinct from a non-demountable sealed beam unit. The fact that the flange 21 is fixed at a predetermined distance from the light source enables a lighting equipment designer to design equipment accordingly. Demountable systems, allowing replacement of their lamps, include, interalia, slide and film projectors.

In an alternative method of assembly of a sealed beam unit, the lamp is inserted from the front of the reflector and the flange of the cap in scaled to the front surface of the reflector.

In a modification of the lamp structure the supply leads emerging from the press seal we attached to terminal line which pass through and are hermetically sealed in the apertures 30 and form current leads for the lamp.

I claim:

1. An electric lamp comprising an envelope containing a light source, said envelope having a press seal and supply leads entering the envelope through the press seal, said lamp further comprising a metal cap, said cap having an integral peripheral flange, a support mounting said envelope on said cap, said support being attached to the press seal of the envelope, and current leads passing through openings in said cap and hermetically sealed in said openings by electrically insulating material which insulates said leads from said cap.

2. An electric lamp as claimed in claim 1 comprising depressions in the outer surface of said cap, said openings being formed in the depressions, and fused beads of electrically insulating material received in said depressions and hermetically sealing said current leads in said openings.

3. An electric lamp as claimed in claim 1 wherein said support has spaced legs secured in the inner wall of said cap.

* * * * *